United States Patent [19]

Diamond

[11] Patent Number: 5,017,762

[45] Date of Patent: May 21, 1991

[54] CONCENTRIC ROTATING DISC ASSEMBLY

[76] Inventor: Israel Diamond, 731 Dickens Ave., Franklin Square, N.Y. 11010

[21] Appl. No.: 504,010

[22] Filed: Apr. 4, 1990

[51] Int. Cl.[5] ..... G06C 1/00

[52] U.S. Cl. ..... 235/78 R

[58] Field of Search ..... 235/78 R, 70 R, 88 R, 235/89 R; 40/495

[56] References Cited

U.S. PATENT DOCUMENTS

| | | | |
|---|---|---|---|
| 1,162,230 | 7/1915 | Foster | 486/121.1 |
| 1,714,839 | 10/1929 | Ashburn | 273/142 A |
| 2,423,764 | 4/1947 | Flitton | 235/78 |
| 2,435,885 | 10/1948 | Gewirtzman | 273/142 |
| 2,492,906 | 1/1949 | Voges | 46/36 |
| 3,051,383 | 8/1962 | Payne | 235/78 R |
| 3,249,085 | 8/1966 | St. Jean | 116/133 |
| 3,280,788 | 11/1966 | Robinson | 116/120 |
| 3,902,656 | 9/1975 | Rothchild | 235/89 R X |
| 4,132,348 | 1/1979 | Bromberg | 235/89 R X |
| 4,323,609 | 12/1980 | Bromberg | 235/78 R |
| 4,538,055 | 8/1985 | Riehle | 235/78 R X |

*Primary Examiner*—L. T. Hix
*Assistant Examiner*—Eddie Lee
*Attorney, Agent, or Firm*—Natter & Natter

[57] ABSTRACT

A concentric rotating disc assembly includes a pair of outer discs and an intermediate disc. The intermediate disc rotates about a journal which is die cut from the center of the intermediate disc with each face of the journal adhesively secured to an inner face of an abutting outer disc. The assembly is fabricated from a rectangular paperboard blank having parallel fold lines which divide the blank into three square panels. Score lines are provided in each panel to define its respective disc and a central circular score line in the intermediate panel defines the periphery of the journal. When the panels of the blank are folded along their fold lines in a predetermined order, the panel carrying the intermediate disc is positioned between the panels carrying the outer discs and all discs are concentrically registered. Fabrication is completed by removing excess portions of the panels from the discs along the score lines and then rotating the intermediate disc about the journal to separate the intermediate disc from the journal.

11 Claims, 2 Drawing Sheets

FIG. 1
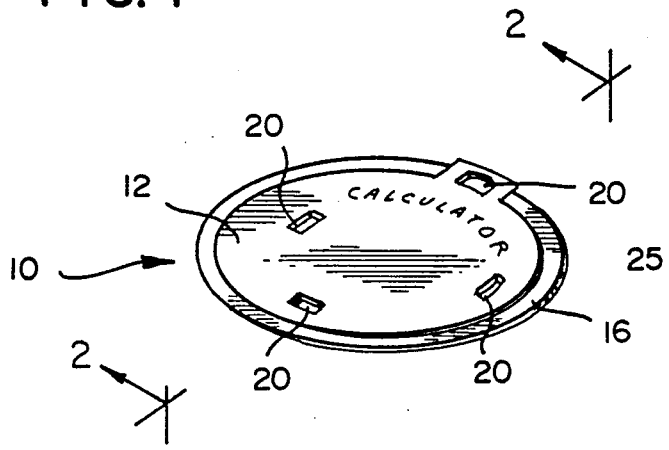
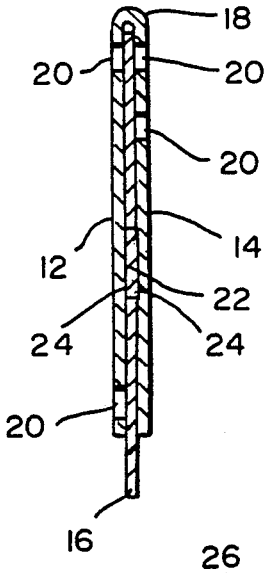
FIG. 2
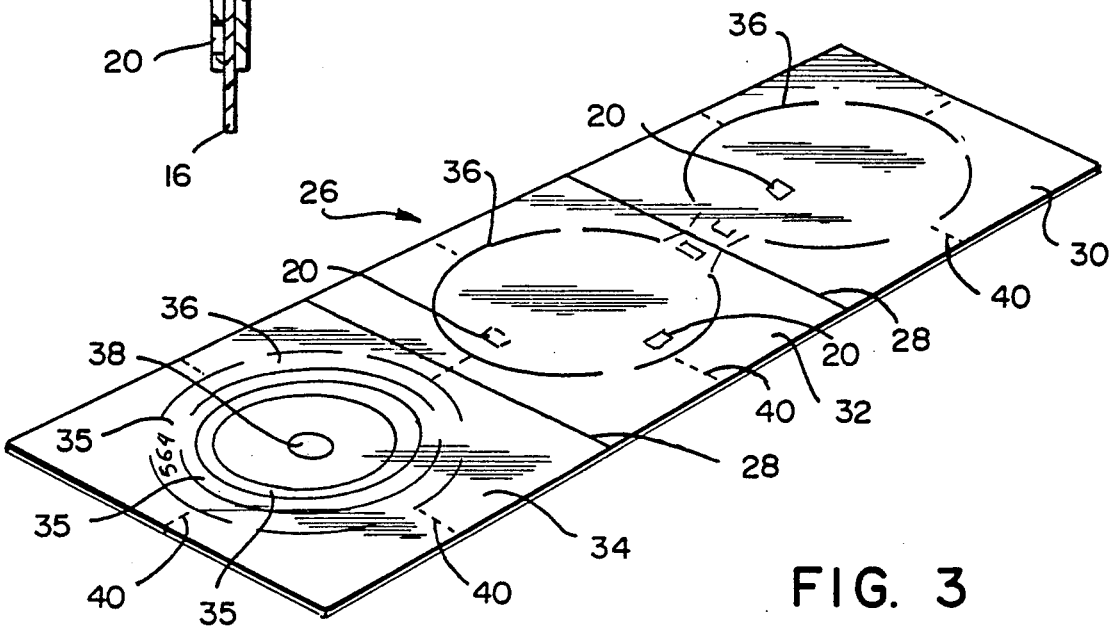
FIG. 3

FIG. 5
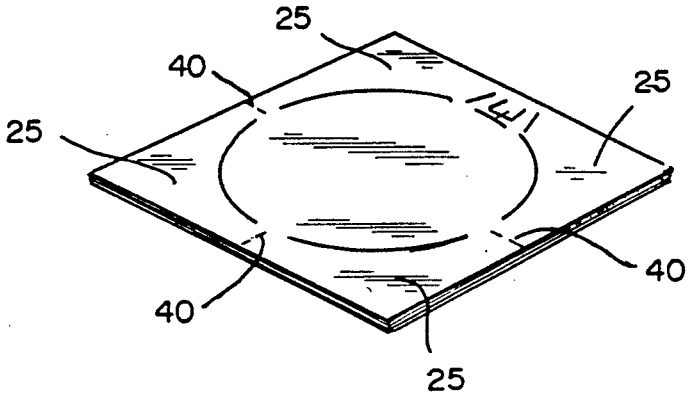
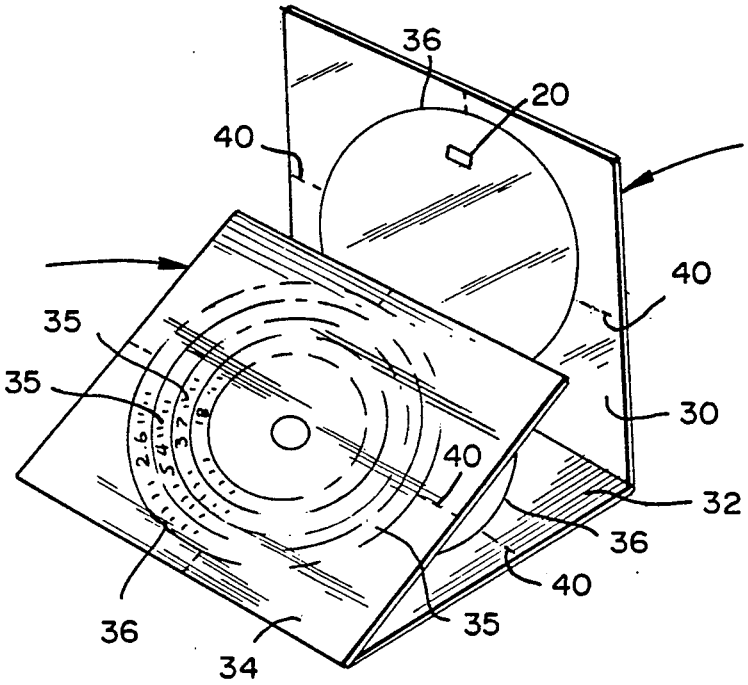
FIG. 4
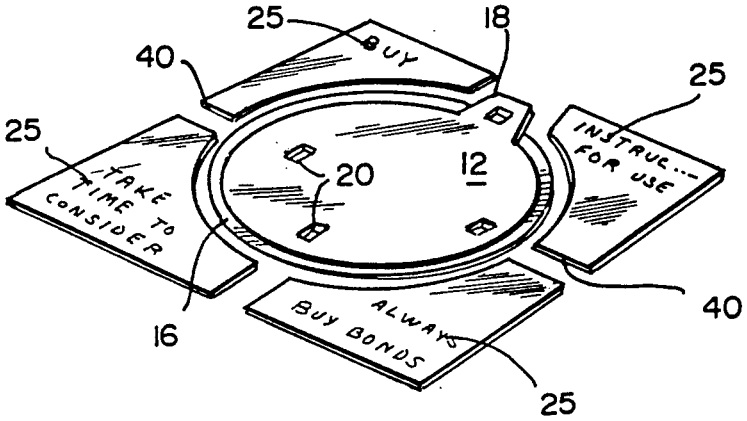
FIG. 6

CONCENTRIC ROTATING DISC ASSEMBLY

BACKGROUND OF THE INVENTION

1. Field of the Invention

This invention relates generally to assemblies comprising indicia carrying concentric rotating discs and more particularly to an assembly for use as a slide rule, game, display device, reference guide or the like as well as a method of fabrication.

2. Background Disclosure

Assemblies of indicia bearing concentric rotating discs have been traced to the early seventeenth century and the development of analog calculating deices. Until the advent of electronic calculators, the logarithmic slide rule was a widely used, virtually essential, tool in mathematical science and engineering. Slide rules were used to rapidly perform calculations in such fields despite their somewhat limited accuracy.

The origins of the slide rule developed in 1620 from the recognition by Edmund Gunter, an English mathematician, that by plotting logarithms on a line, addition and subtraction of lengths by a pair of dividers would result in multiplication and division calculations. Another English mathematician, William Oughtred constructed a pair of Gunter's lines on concentric circular discs. Gunter's dividers were replaced by an opening index in one of the discs. Oughtred also fashioned two Gunter's scales in straight form with the scales held against one another and thus invented the precursor of linear slide rules.

Linear, rather than circular, slide rules became popular with the modern linear slide rule based upon an 1859 design of Amedee Mannheim. The prevalence of linear slide rules was due, in part, to the fact that circular slide rules were more difficult to manufacture. The increased manufacturing difficulty was attributed to the cutting and assembly of discs as well as inscribing circular scales.

The basic mode of construction of circular slide rules was incorporated throughout the years in various applications without imprinted logarithmic scales For example, the use of concentric circular discs has been employed in computing and calculating devices such as air navigation computers as illustrated in U.S. Pat. No. 2,423,764, nautical data corrolators as illustrated in U.S. Pat. No. 3,249,085, duplicate bridge scoring devices as shown in U.S. Pat. No. 3,280,788, and in animated display devices as illustrated in U.S. Pat. No. 2,492,906 and games as illustrated in U.S. Pat. Nos. 1,714,839 and 2,435,885.

These concentric rotating disc devices generally included at least three layers of discs with at least one of the discs being rotatable relative to the others and with openings provided in one of the discs for viewing only a selected portion of the indicia carried on another disc.

Manufacture of concentric rotating disc assemblies, such as those illustrated in U.S. Pat. Nos. 2,423,764, 3,249,085 and 3,280,788, generally included imprinting indicia on one or both faces of at least three separate discs with the discs having a die cut circular periphery, a central aperture and one or more window cursors. The printed discs were then assembled and an axle in the form of a solid rivet or an eyelet was inserted through the central aperture in each of the discs to secure the discs together while permitting relative rotation between the discs.

Among the problems which were encountered in manufacturing were the possibility of unskilled laborers inadvertently assembling the discs in an improper order or assembling the discs with a printed face oriented in an improper direction. Improper assembly destroyed the utility of the device.

U.S. Pat. No. 2,492,906 to VOGES and U.S. Pat. No. 2,435,885 to GERWITZMAN both disclosed a concentric rotating disc assembly which include an inner disc positioned between a front and back outer disc. The front and back outer discs were formed of a single sheet of folded paperboard. While this arrangement assured proper orientation of the outer discs, assembly of the completed device still required positioning the inner disc with its printed indicia facing in the correct directions. In addition, assembly of the device also entailed proper alignment of the central apertures of the outer discs and the inner disc and the subsequent insertion of an axle pivot and was susceptible to misalignment.

While concentric rotating disc assemblies would naturally have lended themselves to distribution as promotional or premium items due to their apparently simple construction of relatively inexpensive materials such as paperboard, because of the factors which inhibited low cost mass production and assembly, concentric rotating disc devices have been relatively costly and have not gained widespread acceptance.

SUMMARY OF THE INVENTION

In compendium, the invention comprises a concentric rotating disc assembly which is formed of a pair of outer discs and an intermediate disc, rotatable with respect to the outer discs. The assembly includes an integral journal which is die cut from the center of the intermediate disc. Each face of the journal is adhesively secured o an inner face of one of the outer discs so that the outer discs rotate in unison relative to the intermediate disc.

The rotating disc assembly is formed from a rectangular paperboard blank having a pair of spaced transverse fold lines which divide the blank into three substantially similar panels. A circumferential score line representing the periphery of a disc is die cut into each panel and the intermediate panel includes a concentric circular score line of smaller radius which defines the periphery of the journal. Score lines may be additionally die cut to provide cursors or windows.

The blank is preferably preprinted with appropriate indicia within areas of the discs as well as other areas of the panels from which the outer discs are formed. The panels of the blank are folded along their fold lines in a predetermined order with the panel carrying the intermediate disc positioned between the panels carrying the outer discs. The outer discs are adhesively joined to the journal while concentric registration of all discs is assured by their fixed position within each panel.

The discs may be separated from their respective panels along the score lines to provide the completed rotating disc assembly.

From the foregoing summary, it should be appreciated that it is an aspect of the present invention to provide a concentric rotating disc assembly of the general character described which is not subject to the disadvantages of the background disclosure aforementioned.

A consideration of the present invention is to provide a concentric rotating disc assembly which is adapted for manufacture by economical mass production.

A feature of the present invention is to provide a concentric rotating disc assembly of the general character described which does not require the mounting of a separate rivet or eyelet for assembly.

A further aspect of the present invention is to provide a blank from which a concentric rotating disc assembly of the general character described may be formed which blank simplifies manufacturing by facilitating the orientation and registration of concentric components.

A further consideration of the present invention is to provide a concentric rotating disc assembly of the general character described which is well suited for utilization in promotional programs.

Yet another aspect of the present invention is to provide a method of making a concentric rotating disc assembly of the general character described which utilizes discardable blank material for advertising copy.

To provide a concentric rotating disc assembly of the general character described which is well suited for manufacture by relatively unskilled labor is yet another consideration of the present invention.

A still further consideration of the present invention is to provide a method of making a rotating disc assembly of the general character described which is low in cost.

Other aspects, features and considerations of the present invention in part will be obvious and in part will be pointed out hereinafter.

With these ends in view, the invention finds embodiment in certain combinations of elements, arrangements of parts and series of steps by which the aspects, features and considerations and certain other aspects, features and considerations are hereinafter attained, all as fully described with reference to the accompanying drawings and the scope of which is more particularly pointed out and indicated in the appended claims.

BRIEF DESCRIPTION OF THE DRAWINGS

In the accompanying drawings in which is shown one of the various possible exemplary embodiments of the invention, FIG. 1 is a perspective illustration of a rotating disc assembly constructed in accordance with and embodying the invention and showing an outer disc having a plurality of cursor windows each positioned at a different radial distance from the center of the disc and an intermediate disc of larger diameter having indicia printed in various circular arrays with selected indicia of each circular array being viewable through one of the cursor windows and with the intermediate disc being rotatable relative to the outer disc;

FIG. 2 is an enlarged scale sectional view through the rotating disc assembly, the same being taken substantially along the plane 2—2 of FIG. 1 and showing the front and a rear outer disc interconnected along an integral web and a journal about which the intermediate disc rotates;

FIG. 3 is a perspective illustration of a blank from which the rotating disc assembly is manufactured and showing a pair of parallel fold lines which divide the blank into panels;

FIG. 4 is a perspective illustration of the blank illustrating the process of folding the panels relative to one another showing manufacture of the rotating disc assembly;

FIG. 5 is a perspective illustration of the folded blank suitable for distribution to an end user; and FIG. 6 is a perspective illustration of the removal of corner portions of each panel prior to use.

DESCRIPTION OF THE PREFERRED EMBODIMENTS

Referring now in detail to the drawings, the reference numeral 10 denotes generally a rotating disc assembly constructed in accordance with and embodying the invention. The rotating disc assembly illustrated in FIGS. 1 and 2 comprises a pair of substantially circular outer discs including a front disc 12 and a rear disc 14. Positioned between the front disc 12 and the rear disc 14 is an intermediate disc 16 which is of larger diameter than at least the front disc 12. The discs, 12, 14, 16 are preferably formed of low cost paperboard. If desired, the front and rear discs 12, 14 may be joined by an integral, radially projecting, web 18 which is formed of one piece construction with both the front and rear discs.

As common with various conventional rotating disc assemblies, the front disc 12 and, optionally the rear disc 14, include a plurality of cut out cursor windows 20 each positioned at a different radial length and each of which registers with indicia imprinted on the intermediate disc 16 along circular arrays positioned at different radial lengths. Ar least one cursor window 20 is provided for each circular array of indicia imprinted on the intermediate disc 16. The cursor need not comprise a window and may be a reference marker projecting from or printed on one or both of the outer discs as well as on the inner disc.

It should be noted that the intermediate disc 16 rotates relative to the front and rear discs 12, 14 about a journal 22 which is cut from the intermediate disc itself during fabrication of the rotating disc assembly 12. Opposite faces of the journal 22 are fixed to the registered abutting interior faces of the front and rear discs 12, 14 by a suitable adhesive 24, which may comprise a layer of pressure sensitive adhesive.

Imprinted on the outer faces of the front and rear discs may be found suitable indicia 25 relating to an advertiser as well as instructions for use of the assembly 10. For example, the indicia 25 may comprise instructions for rotation of the intermediate disc and reading appropriate data or other printed indicia at selected cursor windows, in a manner common with prior assemblies.

With attention now directed to FIGS. 3 through 6 which illustrate various stages in the manufacture of the assembly 10, it will be noted that the assembly 10 is fabricated of a substantially rectangular paperboard blank 26. The blank 26 has a width approximately three times its height and is divided by a pair of parallel fold lines 28 which are substantially equidistantly spaced from each other as well as from opposite side edges of the blank 26. The fold lines 28 thus separate the blank into three substantially square panels, a front disc panel 30, a rear disc panel 32 and an intermediate disc panel 34. The obverse faces of the front disc panel 30 (shown in FIGS. 5 and 6) and rear disc panel 32 are printed with the appropriate indicia 25 and one or both faces of the intermediate disc 16 within the panel 34 are imprinted with concentric circular arrays of indicia 35.

Within each of the panels 30, 32, 34, a circular score line 36 defines the periphery of its respective disc. The score line is die cut substantially completely through the paperboard blank 26 leaving, however, areas wherein the cut is incomplete such that the respective discs remain an integral component of each of the panels. It should also be noted that the score lines 36 formed in the front and rear disc panels 30, 32 may be configured to provide the radially projecting webs 18.

A concentric relatively small diameter die cut circular score line 38 is provided in the intermediate disc panel 34. The score line 38, like the score lines 36, has portions which are not completely cut through the paperboard blank such that the journal 22, defined by the score line 38, remains a part of the intermediate disc panel 34.

Additionally, each of the panels 30, 32, 34 includes radial score lines 40 which extend from the periphery of each circular score line 36 to the peripheral edge defining the respective panel. As will be hereinafter explained, the radial score lines 40 serve to facilitate breaking away portions of the blank which are later removed in the final stage of fabrication of the assembly.

In accordance with the invention, the blank is imprinted with indicia 25 including, for example, advertising copy on the outer faces of the front disc panel and rear disc panel 32 and corner portions of each panel which are not included within the disc. Also, suitable arrays of indicia 35 are imprinted on one or both faces of the intermediate disc panel, within the circular score line 36 which defines the periphery of the intermediate disc 16. Additionally, all of the appropriate cursor windows 20 are die cut and all of the score lines are die cut. Such intermediate stage of fabrication is illustrated in FIG. 3. At this juncture, completion of the rotating disc assembly becomes a simple matter well suited for relatively unskilled manual labor.

A layer of adhesive 24, such as a pressure sensitive adhesive is deposited within the journal area defined by the circular score line 38 on both faces of the intermediate disc panel 34. The depositing of such adhesive may be accomplished automatically as part of or subsequent to the printing and/or die cutting operations. Alternately, the adhesive 24 may be deposited on the inner faces of the panels 30, 32 in registration with the journal. To fabricate the rotating disc assembly 12, a worker need only pivot the disc panel 34 clockwise about the fold line 28 which separates the intermediate disc panel 34 and the rear disc panel 32 as illustrated by the heavy arrow shown in FIG. 4.

After the intermediate disc panel has been completely folded and lies in abutment against the interior face of the rear disc panel 32, the front disc panel 30 is then folded in a counterclockwise direction about its fold line 28 to lie on top of the intermediate disc panel as shown by the heavy arrow in FIG. 4. Compressive force is then applied against the outer panels at their centers to cause the layer of adhesive 24 on each of the faces of the journal 22 to contact and adhere to the interior faces of the respective front and rear disc panels. The thus folded blank 36 is illustrated in perspective view in FIG. 5.

It should be understood that because of the alignment and registration of the score lines with respect to the dimensions of the blank and each of the panels within the blank, once the panels have been folded about their respective fold lines, the discs of the disc assembly 10 will be in concentric registration relative to one another.

In the semi completed form as illustrated in FIG. 5, the rotating disc assembly may be distributed to end users. The end user, prior to actually using the assembly, will break away the corners of all of the panels of the blank, separating each corner from the score line 36 which define the respective disc as well as the radial score lines 40 and, if included, the score lines which define the web 18. The separation of the components along the score lines is a relatively simple task. The separated corners may be retained by the user if the indicia 25 imprinted thereon continues to have utility. It may include, for example a redemption coupon, advertising copy, instructions or reference information.

In the condition illustrated in FIG. 6, the intermediate disc 16 of the rotating disc assembly 10 is still not free to rotate relative to the front and rear disc 12, 14 because the circular score line 38 which defines the journal 22 still includes some portions which have not been completely cut through the intermediate disc panel 34. Such score line 38 may be easily completed by merely rotating the disc 16 relative to the front and rear discs 12, 14.

Thus it will be seen that there is provided a concentric rotating disc assembly which achieves the various aspects, features and considerations of the present invention and which is well suited to meet the conditions of practical usage.

While various possible exemplary embodiments might be made of the present invention and as various changes might be made in the exemplary embodiment above set forth without departing from the spirit of the invention, it is to be understood that all matter herein described or shown in the accompanying drawings is to be interpreted as illustrative and not in a limiting sense.

Having thus described the invention there is claimed as new and desired to be secured by Letters Patent:

1. A concentric rotating disc assembly, the assembly comprising a first substantially circular disc, a second substantially annular disc and a third substantially circular disc, the second disc being positioned between the first and the third discs in abutting relationship, indicia carried on one of the discs, cursor means for indexing a selected portion of the indicia, the cursor means being carried on another of the discs, each disc being formed of a substantially planar panel, means concentrically mounting the discs for rotation of the second annular disc relative to the first disc, the mounting means comprising a journal, the journal comprising a concentric central circular portion of the panel from which the second annular disc is formed, the second disc being rotatable about the journal, the assembly further including means nonrotatably securing the first and the third discs to the journal.

2. A rotating disc assembly as constructed in accordance with claim 1 wherein the means securing the first disc to the journal comprises an adhesive.

3. A rotating disc assembly as constructed in accordance with claim 1 wherein the one disc comprises the second disc, the other disc comprises the first disc and the cursor means comprises a window cut through the first disc.

4. A rotating disc assembly as constructed in accordance with claim 1 wherein the panels are formed of paperboard.

5. A substantially rectangular blank for construction of a rotating disc assembly as constructed in accordance with claim 1, the blank being formed of planar sheet material including a pair of spaced parallel transverse fold lines, the fold lines separating the blank into substantially square panels, each of the panels having a score line defining one of the discs, the score line extending substantially completely through the sheet material, the panel within which the second disc is defined including a second, concentric circular score line, the second score line having a radius smaller than the radius of the score line which defined the second disc, the second score line extending substantially completely through the sheet material in a central are of the second disc and defining the journal, the score lines being so positioned with respect to the fold lines as to register the respective discs within each panel, concentrically with respect to one another when the panels are folded along the fold lines.

6. A folded blank assembly as constructed in accordance with claim 5, the panel which includes the first disc carrying printed indicia on a peripheral area between the score line and the periphery of the panel, the peripheral area being manually removable by separation from the disc along the score line.

7. A blank for construction of a rotating disc assembly as constructed in accordance with claim 5 further including a layer of adhesive, the layer of adhesive being positioned on opposed faces of the panel which carries the score line which defines the journal, whereby when the panels are folded about the fold lines, faces of the journal will be secured to the first and third discs.

8. A blank for construction of a rotating disc assembly, the blank comprising a substantially rectangular sheet of planar material, the blank having a pair of spaced parallel transverse fold lines extending substantially perpendicular to the longitudinal edges of the blank, the fold lines separating the blank into substantially square panels, each of the panels having die cut circular score lines defining a disc, the score lines extending substantially completely through the sheet material, one of the panels including a second score line, the second score line being substantially circular, concentric with and positioned within the score line defining a disc, the second score line extending substantially completely through the sheet material and defining a journal, the score lines being so positioned with respect to the fold lines as to register the respective discs defined by the score lines concentric with respect to one another when the panels are folded along the fold lines.

9. A method of fabrication of a rotating disc assembly utilizing the blank as constructed in accordance with claim 7, the method comprising the steps of:

(a) folding the panel within which the second disc is defined about a fold line against the panel within which the first disc is defined;

(b) folding the panel within which the third disc is defined about the remaining fold line and against the panel within which the second disc is defined to provide a folded panel structure wherein the panel within which the second disc is defined is positioned between the panels within which the first and third discs are defined;

(c) securing the panels within which the first and third discs are defined to that portion of the panel within which the second disc is defined which is within the score line defining the journal; and (d) separating the second disc from the journal by rotating the second disc relative to the journal.

10. A method of fabricating a rotating disc assembly in accordance with claim 9 further including the step of:

(e) separating each disc from its respective panel along the respective score line prior to separating the second disc from the journal.

11. A method of fabricating a rotating disc assembly in accordance with claim 9 wherein the panels within which the first and the third discs are defined are secured to the panel within which the second disc is defined by applying an adhesive between the journal and the first and third discs.

* * * * *